United States Patent [19]

Morgan

[11] Patent Number: 4,795,387

[45] Date of Patent: Jan. 3, 1989

[54] COLLAPSIBLE INNER TUBE SEAT INSERT

[76] Inventor: James E. Morgan, P.O. Box 441, New Braunfels, Tex. 78130

[21] Appl. No.: 80,191

[22] Filed: Jul. 28, 1987

Related U.S. Application Data

[63] Continuation of Ser. No. 806,674, Dec. 9, 1985, abandoned.

[51] Int. Cl.[4] ..... A49B 19/00

[52] U.S. Cl. ..... 441/130; 441/131

[58] Field of Search ..... 441/130–132, 441/40, 67; 114/345, 346, 363; 272/1 B

[56] References Cited

U.S. PATENT DOCUMENTS

| | | | |
|---|---|---|---|
| 1,743,333 | 1/1930 | Ely | 441/131 |
| 1,748,170 | 2/1930 | Chesnut | 441/131 |
| 1,764,852 | 6/1930 | Phillips | 441/131 |
| 1,793,905 | 2/1931 | Chesnut | 441/131 |
| 1,869,186 | 7/1932 | Davidson | 441/131 |
| 2,080,216 | 5/1937 | Rey | 441/131 |
| 2,124,062 | 7/1938 | Grant | 441/40 |
| 3,021,536 | 2/1962 | Haggerty | 441/40 |
| 4,160,299 | 7/1979 | Hilbern | 441/131 |
| 4,449,473 | 5/1984 | McCrory et al. | 114/354 |

*Primary Examiner*—Joseph F. Peters, Jr.
*Assistant Examiner*—Clifford T. Barfz
*Attorney, Agent, or Firm*—Cox & Smith

[57] ABSTRACT

A seat insert which can be inserted into an inflated or uninflated inner tube by allowing portions of the seat insert to pivot relative to each other the seat insert so that can be inserted into the tube, forced downwardly into longitudinal alignment, and locked into place in the inner tube.

15 Claims, 2 Drawing Sheets

COLLAPSIBLE INNER TUBE SEAT INSERT

This applicaton is a continuation of my co-pending application Ser. No. 806,674, filed on Dec. 9, 1985 now abandoned.

BACKGROUND OF THE INVENTION

The present invention relates to a recreational floating device. More particularly, the present invention relates to a collapsible inner tube seat insert.

In recreational water sports, one of the most popular sports is known as "tubing". This sport is especially popular in rivers where moderate to small rapids are found. Of course, inner tubes are also used on other bodies of water for a wide variety of uses.

While inner tubes enjoy great popularity because of their availability and low cost, there are several practical drawbacks to their use. First, when floating on an inner tube, the body is commonly placed inside the inner tube, with legs and arms being placed over the top of the tube to keep the person from falling through. In order to be comfortable for long periods of time, the tube should be relatively small so that the arms can hang over the side of the tube. If the tube is too large in diameter, this may be more comfortable as far as the body not being folded into a cramped position, but the sides of the tube are farther away, and the arms become tired because the weight of the person's body must be supported farther down on the arms. Thus, it can be seen that if the tube can be deformed in an axis parallel to the body, the sides of the tube would be drawn in closer, while more room is allowed along the length of the body.

The second drawback to inner tubes is that the lower back and bottom of a person will protrude through the tube, which can cause problems in shallow rapids where these parts of the body may drag over rocks or other obstacles. Thus, providing a seat inside the inner tube that would support these parts of the body would avoid collisions with underwater objects.

Another problem with inner tubes relates to the location of their normal use. Normally, tubing is done in lakes or rivers, which can be remote from supplies of compressed air. Thus, it can be seen that if a device which can overcome the above problems is to be easily detachable from the inner tube, it should be able to be inserted and withdrawn from the inner tube while the tube is inflated.

Among the prior art references which propose deforming or stretching the tube along the longitudinal axis are U.S. Pat. Nos. 2,124,062 (issued to Grant, et al.), 2,080,216 (issued to Rea) and 1,869,186 (issued to Davidson). However, the Davidson reference requires that the tube be deflated before the seat can be inserted or withdrawn. Grant, et al., seems to suffer from the same limitation, as does the Rea reference.

In addition to the references cited, other references also disclose seat arrangements for inner tubes, including U.S. Pat. Nos. 1,743,333 (issued to Ely), 1,748,170 (issued to Chesnut), 1,764,852 (issued to Phillips), 1,793,905 (issued to Chesnut), 3,021,536 (issued to Haggerty), and 4,160,299 (issued to Hilbern). However, none of these references seek to deform the inner tube along the longitudinal axis to make it more closely fit the contours of the human body.

The inner tube seat insert which can overcome the above-mentioned problems should be easy to insert and remove, and should be capable of doing so with an inflated tube. This goal is best accomplished by a collapsible frame of some sort which can be placed inside the inner tube and locked into place once the desired stretching of the tube has occurred. As mentioned, Grant, et al., accomplishes the deformation and provides a seat for a child, but teaches a rigid frame which requires that the inner tube be placed around the frame in a deflated state and then inflated. A reference to McCrory, et al., (U.S. Pat. No. 4,449,473) discloses a demountable transom on an inflatable boat. Besides being for a completely different purpose, the reference contains several structural differences from the present invention which would make the structure taught by that reference incapable of accomplishing the purposes set forth below.

Therefore, it is the purpose of the present invention to provide an easily insertable and removable seat for an inner tube which stretches the inner tube to more closely follow the shape of the human body.

It is a further object of the present invention to provide a seat for an inner tube which can easily be inserted or removed without inflating or deflating the tube.

It is a further object of the present invention to provide a seat for inserting within an inner tube.

These and other objects, features and advantages of the invention will be made evident by the following detailed description of a presently preferred embodiment, of the invention.

SUMMARY OF THE INVENTION

The invention is a collapsible inner tube seat insert comprising tube engaging means mounted on the ends of insert frame bars, the insert frame bars being mounted to each other by a mounting means, the mounting means allowing the frame bars to collapse relative to each other so the tube engaging means can be removed from or inserted into an inner tube while it is inflated, and a seat mounted to one of the frame bars. The mounting means is preferably comprised of a pivot pin connecting the frame bars so they may pivot relative to each other and a locking means for holding the frame bars in place when they are pivoted into substantial longitudinal alignment. The tube engaging means is preferably comprised of a semi-circular bracket for engaging the inner portion of the inner tube. The seat insert may also comprise a foot rest attached to one of the frame bars.

DESCRIPTION OF THE INVENTION

Figure 1:
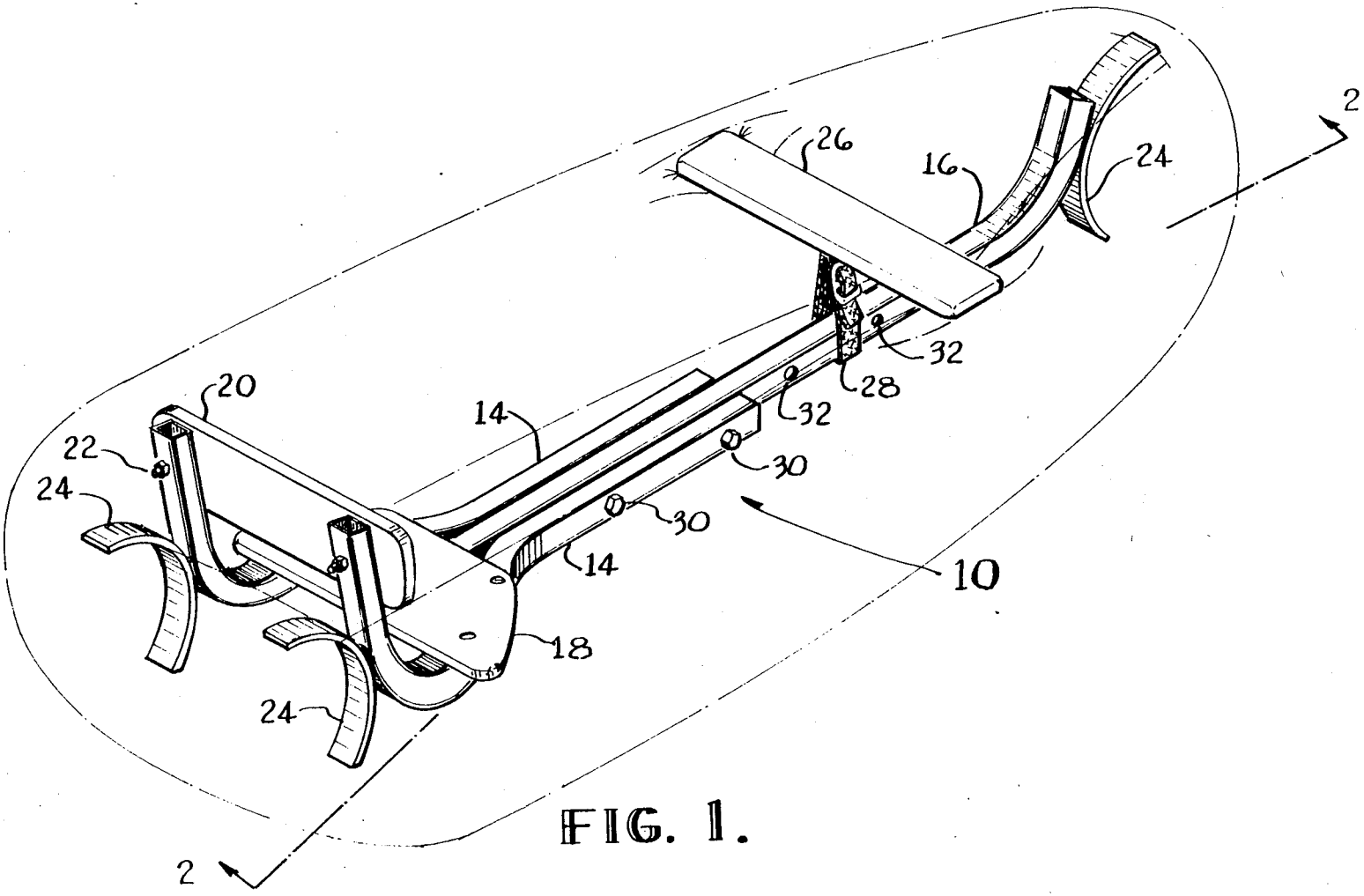
FIG. 1 is a top perspective view of the collapsible inner tube seat insert of the present invention showing the seat insert installed in an inner tube.

The seat insert, labeled generally as 10, is shown inserted into an inner tube 12 in FIG. 1. As can be seen, the seat insert 10 deforms the inner tube 12 about the longitudinal axis to make it more comfortable for a person to fit inside the tube 12. An incidental advantage of the deformation of the tube 12 is that it makes the tube 12 more aquadynamic, so that it flows through the water more steadily.

The seat insert 10 is, in the presently preferred embodiment, comprised of two frame bars, including a seat frame bar 14 and a foot frame bar 16. In the presently preferred embodiment, both types of bars are constructed of hollow, square metal tubing, such as is known in the art. The seat frame bar 14 is comprised of two mirror image bars (both designated by the reference numeral 14) shaped to curve from the back of a person around the seat and straight out, as if the person were sitting on the floor. Also, the seat frame bars 14 are curved to spread out from one another to provide better support over the seat 18 and back 20. In the presently preferred embodiment, the seat 18 and back 20 are mounted to the seat frame bars 14 by a mounting means 30 which is comprised of nuts and bolts as will be explained. As the seat frame bars 14 curve upwardly into a back portion 22, a tube engaging means 24 is mounted to the end of each for holding the seat insert 10 in place in the inner portion of inner tube 12. In the presently preferred embodiment, a pair of C-shaped brackets serve as the tube engaging means 24 and each is affixed to the back frame bar portion 22 by a welded connection. The radius of the tube engaging means 24 should be large enough to fit around the tube 12, but not so large that the upper and lower portions of the tube 12 would not be gripped to hold the seat insert 10 into place.

A single foot frame bar 16 is provided which starts beneath the seat 18 and runs between the two seat frame bars 14 to the opposite end of the inner tube 12. The foot frame bar 16 likewise curves upwardly in a manner similar to the back frame bar portion 22, although the purpose of the curve is to provide another tube engaging means 24 to hold the opposite end of the inner tube 12, the tube engaging means 24 being attached to the foot frame bar 16 by a welded connection.

Further, in FIG. 1 can be seen the foot rest 26 which is mounted to the foot frame bar 16 by a strap 28. The foot rest 26 is of sufficient width so as to rest on top of the inner tube 12 instead of falling through. Thus, when the seat insert 10 is placed in the inner tube 12, the strap 28 should be of slightly insufficient length to cause the foot rest 26 to be pulled snugly down onto the inner tube 12 and therefore remain fairly rigid. Because the foot rest 26 is merely attached by the strap 28, which is looped around the foot frame bar 16, the foot rest 26 can be adjusted away from or towards the seat 18 by sliding the strap 28 to the desired position.

The seat frame bars 14 and foot frame bar 16 are, in the presently preferred embodiment, mounted to each other by a mounting means 30. The mounting means 30 is comprised of a pair of bolts running transversely through the seat frame bars 14 and foot frame bar 16 through holes drilled in the bars. Optional holes 32 may be provided in the foot frame bar 16 to adjust the length of the seat insert 10, so that seat insert 10 can be used on inner tubes of a variety of diameters.

Figure 3:
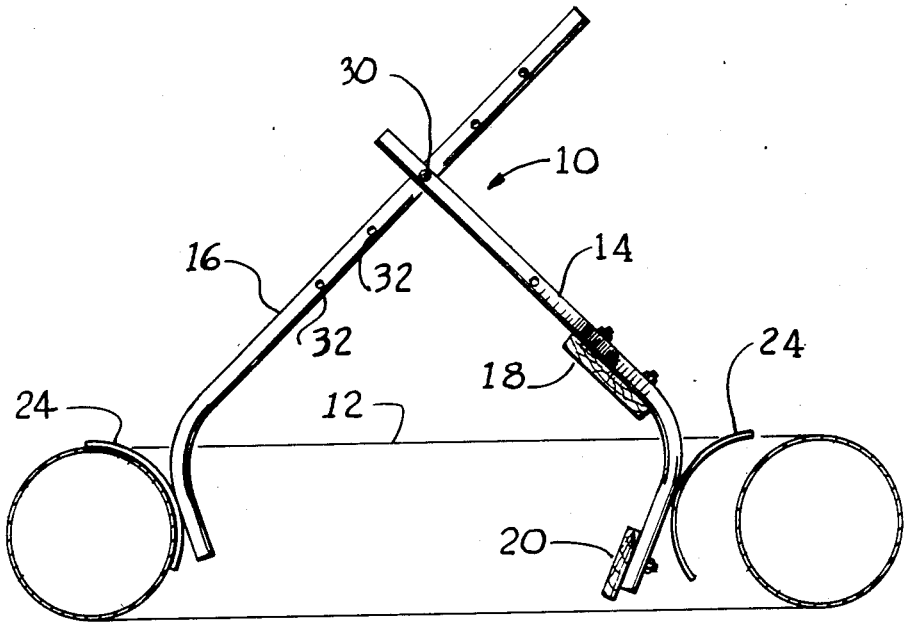
FIG. 3 is a side view of the collapsible inner tube seat insert before installation in an inner tube, as seen in the cross-sectional view taken along lines 2—2 of FIG. 1.
Figure 2:
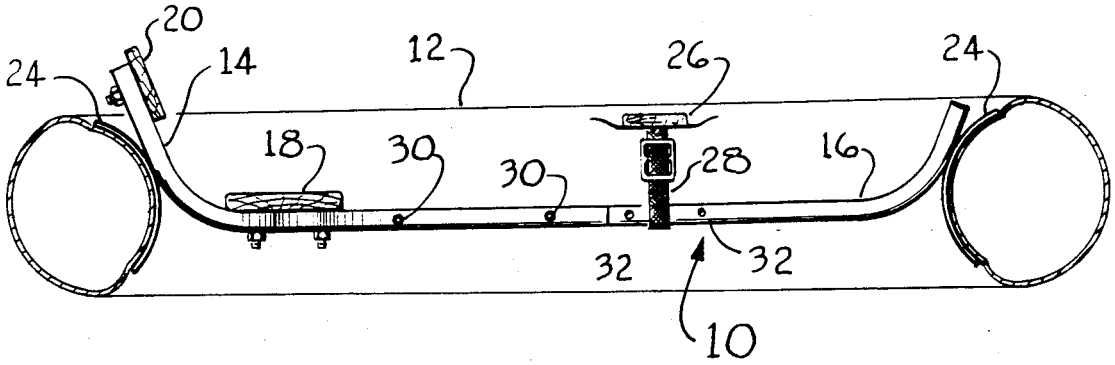
FIG. 2 is a cross-sectional view of the collapsible inner tube seat insert as installed in an inner tube, taken along lines 2—2 of FIG. 1.

The operation of the seat insert 10 is shown clearly in FIGS. 2 and 3. As stated, the collapsible feature of the seat insert 10 is important because seat insert 10 can be placed in the inner tube 12 with or without deflating the tube 12. Generally, the bolt comprising the mounting means 30 closest to the seat 18 is removed so that the seat frame bars 14 pivot relative to the foot frame bar 16, at least to a position as shown in FIG. 3. Once the tube engaging means 24 are positioned inside the inner tube 12, pressure can be applied on mounting means 30 in a downward fashion, as shown in FIG. 3, to stretch the tube 12 into the deformed position shown in FIGS. 1 and 2. The second bolt of mounting means 30 is then inserted when the holes of the foot frame bar 16 are aligned with the holes in the seat frame bars 14. The foot rest 26, because of the flexible strap 28, is turned sideways and rotated to fit on top of the inner tube 12 by slightly depressing the inner tube 12.

Of course, other means for making the seat insert 10 collapsible are feasible, such as making the frame bars telescope relative to each other. However, the frame bars should be designed so that the tube 12 can be deformed with relative ease, as the resiliency of an inflated tube 12 can be difficult to overcome without some sort of mechanical leverage, such as shown in the presently preferred embodiment, to lessen the force required to deform the tube 12.

Although the invention has been described in the above presently preferred embodiment, many alternatives, variations, and modifications are apparent to those of ordinary skill in the art. Those alternatives, variations and modifications are intended to fall within the spirit and scope of the appended claims.

I claim:

1. A method for constructing an elongate canoe-shaped boat from an inner tube and an insert frame comprising:

pivoting elongate frame bars to each other with a first bolt to form an insert frame;

positioning tube engaging means mounted to the ends of the elongate frame bars inside the inner portion of an inner tube, the elongate frame bars of the insert frame extending upwardly out of the horizontal plane of the inner tube at an angle to one another;

exerting downward pressure on the insert frame so as to align the frame bars in a horizontal plane substantially parallel to the horizontal plane of the inner tube, thus stretching the inner tube into a deformed position along the axis of the aligned elongate frame bars; and inserting a second bolt into the elongate frame bars to releasably lock the insert frame into the inner tube.

2. The method of claim 1 additionally comprising attaching a foot rest to a strap looping around the insert frame to cause the foot rest to be pulled downwardly into snug engagement with the top surface of the inner tube.

3. A collapsible inner tube seat insert comprising:

tube engaging means mounted on the ends of first and second insert frame bars;

means for connecting said first and second insert frame bars;

a seat mounted on one of said first or second insert frame bars; and said connecting means allowing said first and second insert frame bars to pivot in relation to an inner tube in a plane substantially perpendicular to the tube by exerting upward or downward pressure on said first or second insert frame bars so said tube engaging means can be removed from or inserted into an inner tube while inflated.

4. The seat insert as set forth in claim 3 including a footrest attached to one of said first or second insert frame bars and suspended at the ends thereof upon the inner tube.

5. A collapsible seat insert for mounting inside the inner portion of an inflated inner tube comprising:

a first elongate frame bar having means at one end thereof for engaging the inner portion of an inner tube;

a second elongate frame bar pivotally connected at one end thereof to said first frame bar and having means at the other end thereof for engaging the inner portion of an inner tube, said first and second frame bars being selectively positionable in a first position in which the inner tube engaging means of said first and second frame bars engage the inner portion of an inner tube and said first and second frame bars are not aligned in the same horizontal plane with respect to the horizontal plane of the inner tube, and a second position in which said first and second frame bars are aligned in substantially the same horizontal plane by exerting downward pressure on said first or second frame bars, causing the inner tube to be deformed along an axis substantially parallel to said first and second frame bars when in said second position; and means for releasably locking said first and second frame bars in said second position.

6. The collapsible seat insert of claim 5 wherein said locking means comprises a plurality of holes along the length of each of said first and second frame bars, a first bolt running through one of the holes in said first frame bar and one of the holes in said second frame bar for pivotally connecting said first and second frame bars, and a second bolt running through a second hole in each of said first and second frame bars for locking said first and second frame bars in said second position.

7. The collapsible seat insert of claim 5 additionally comprising a foot rest slidably mounted to one of said first or second elongate frame bars.

8. The collapsible seat insert of claim 7 wherein said foot rest engages the top of said inner tube.

9. The collapsible seat insert of claim 7 wherein said foot rest is attached to a strap looped around either said first or second frame bar for causing said foot rest to be pulled downwardly into snug engagement with the top surface of the inner tube.

10. The collapsible seat insert of claim 5 further comprising a seat mounted to either said first or said second frame bars.

11. A collapsible inner tube seat insert comprising:

an elongate seat frame bar having tube engaging means mounted to the first end thereof;

an elongate foot frame bar having tube engaging means mounted to the first end thereof;

mounting means pivotally connecting the second end of said seat frame bar to the second end of said foot frame bar whereby said foot frame bar and said seat frame bar can be pivoted from a first angled position in which the tube engaging means engage the inside of the inner portion of an inner tube and said mounting means is located in a horizontal plane above the horizontal plane of the inner tube and a second position in which said foot frame bar and said seat frame bar are longitudinally aligned substantially in the horizontal plane of the inner tube by exerting downward pressure on said seat or foot frame bars, causing the tube engaging means to deform the inner tube along substantially the same axis as the aligned foot and seat frame bars; and means for releasably locking said seat frame bar and said foot frame bar in said second position.

12. The collapsible inner tube seat insert of claim 11 where in said mounting means comprises a plurality of holes in said seat frame bar and said foot frame bar, a first bolt running through one of the holes in each of said seat frame bar and said foot frame bar for pivotally connecting said seat and foot frame bars, and a second bolt running through a second hole in each of said seat and foot frame bars for releasably locking said first and second frame bars in said second position.

13. The collapsible inner tube seat insert of claim 11 additionally comprising a footrest slidably mounted to said foot frame bar.

14. The collapsible inner tube seat insert of claim 13 wherein said footrest is mounted to said foot frame bar by a strap looped around said foot frame for causing said footrest to be pulled downwardly into snug engagement with the top surface of the inner tube.

15. The collapsible inner tube seat insert of claim 11 additionally comprising a seat mounted to said seat frame bar.

* * * * *